United States Patent [19]

Young

[11] 4,030,413

[45] June 21, 1977

[54] MECHANISMS FOR FEEDING DOCUMENTS FROM A STACK THEREOF

[76] Inventor: Robert D. Young, Rte. 1, Box 81, Accord, N.Y. 12404

[22] Filed: Apr. 30, 1975

[21] Appl. No.: 573,175

[52] U.S. Cl. ..... 101/232; 101/375; 271/116; 271/119

[51] Int. Cl.[2] ..... B65H 1/04; B41F 5/02

[58] Field of Search ..... 101/131.5, 132, 141, 101/212, 216, 232–242; 271/114–119, 11

[56] References Cited

UNITED STATES PATENTS

| | | | |
|---|---|---|---|
| 1,919,238 | 7/1933 | McCarthy | 271/116 X |
| 2,066,466 | 1/1937 | Gray et al. | 101/236 |
| 2,707,433 | 5/1955 | Roberts | 101/132 |
| 2,887,047 | 5/1959 | McKay | 101/329 |
| 2,975,707 | 3/1961 | Springer | 101/132 X |
| 3,158,366 | 11/1964 | Godlewski | 271/119 X |
| 3,525,517 | 8/1970 | Toby | 271/117 |
| 3,542,357 | 11/1970 | Stoothoff | 271/11 X |
| 3,808,970 | 5/1974 | Delligatti | 101/375 X |

OTHER PUBLICATIONS

IBM Technical Disclosure Bulletin, vol. 14, No. 9, (Feb. 1972), "Automatic Sequential Doc. Feed."

*Primary Examiner*—Edgar S. Burr
*Assistant Examiner*—R. E. Suter
*Attorney, Agent, or Firm*—Strauch, Nolan, Neale, Nies & Kurz

[57] ABSTRACT

Document feeding and/or printing mechanisms including a support for a stack of documents to be printed, a rotatable printer, a feed mechanism for moving successive documents to the printer from the supported stack, and a document stacker on the opposite side of the printer for receiving documents and stacking them after the desired indicia has been printed on them.

5 Claims, 6 Drawing Figures

MECHANISMS FOR FEEDING DOCUMENTS FROM A STACK THEREOF

APPARATUS

This invention relates in one aspect to novel, improved document feed mechanisms. In other aspects my invention relates to novel, improved mechanisms for printing selected information on each of a series of documents and to machines having a combination of feed and printing mechanisms.

The principles of the invention can be employed to particular advantage in the construction of machines for imprinting data on food stamps, checks, and similar documents and will be accordingly developed primarily with respect to the first-mentioned of these applications. However, printing devices in accord with the present invention can equally well be employed for other purposes; and my novel document feed mechanisms can be employed in applications where printing is not involved. Therefore, the description of the invention in the manner just discussed is not intended to limit the scope of protection to which I consider myself entitled.

Printing devices for applications at least generally comparable to those with which I am concerned are shown in U.S. Pat. Nos. 1,077,408 issued Nov. 4, 1913; 1,079,492 issued Nov. 25, 1913; 1,148,509 issued Aug. 3, 1945; and 2,707,433 issued May 3, 1955. Document feed mechanisms superficially resembling those I have invented are disclosed in U.S. Pat. Nos. 1,242,343 issued oct. 9, 1917; 1,551,772 issued Sept. 1, 1925; 2,614,837 issued Oct. 21, 1952; 3,146,532 issued Sept. 1, 1964; 3,306,491 issued Feb. 28, 1967; and 3,542,357 issued Nov. 24, 1970.

It is one important and primary object of my invention to provide novel document feed and printing mechanisms and novel devices for imprinting documents which have advantages not possessed by those heretofore available or disclosed in the foregoing patents or elsewhere in the "prior art".

The novel machines by which the foregoing and other objects of the invention are attained include a support for a stack of documents to be printed, a rotatable printer, a feed mechanism for moving successive documents from the support to the printer, and an arrangement on the opposite side of the printer for stacking the documents after the wanted information has been printed on them.

In a typical application of the invention the printer will be a roll with an impression pad bearing the wanted information attached to it. A freewheeling back-up roll is mounted adjacent the printing roll to press the documents against the printer so that they will be properly printed and will feed positively through the nip between the printer and roll to the stacker. The ends of the printing roll are preferably surrounded with circular members made of a material having a high coefficient of friction. These members increase the friction between the documents and the printing roll and make the feed of the former through the nip between the printing roll and the back-up roll even more positive.

As indicated above, the novel mechanism by which the documents are fed to the printer is also an important invention which may be used in machines other than that just described. As used in a machine of that character, however, the feed mechanism will include an elongated support shaft or member so supported from a drive shaft by which the printing roll is driven that it is parallel to and can swing or pivot in an arc about that shaft.

Rotatably jounalled on this shaft is a hollow drive shaft to which a gear is fixed. This gear meshes with and is driven by a gear fixed to the shaft which drives the printing roll.

A rotatable feed member is journalled on the hollow drive shaft. The feed member hub is fixed to the hollow drive shaft for rotation thereby at a location intermediate the ends of the feed member by an arrangement which allows limited rotation and pivotal movement of the feed member relative to the drive shaft.

The rotatable feed member also has radially oriented, circular, integral flanges at intervals along its hollow hub. These flanges are designed to have a low coefficient of friction. A document engageable, friction drive member having a configuration which is a segment of a circle and made of a material having a high coefficient is detachably affixed to each feed member flange.

Associated with the feed mechanism components so far described are a horizontal document support and a guide or ramp disposed at an angle to the document support and located between the feed member and the printing mechanism. The documents are moved from the document support up this ramp to the printing mechanism by the feed member as it is rotated via the drive train described above.

There are a number of important advantages to this novel feed mechanism.

The manner in which the feed member is fixed to its drive shaft permits the feed member to pivot about the inner, support shaft as the feed member rotates. This insures that the multiple drive members will come into uniform contact with documents stacked on the support even if they are crumpled or bent as they will often be in typical applications of my invention.

The construction of the drive members and their relationship to the low friction flanges on which they are mounted insures that succeeding documents are properly spaced as they are fed to the printing mechanism which is important for self-evident reasons. This is because there will be an interval in each cycle of revolution of the feed member when only the low friction flanges will contact the documents, and no feeding will occur.

Another advantage of the above-discussed construction is that the friction drive members can be easily and quickly replaced. As these are the components most subject to wear, this feature is of obvious importance from a practical viewpoint.

The provision for arcuate or swinging movement of the feed mechanism is also important as this accommodates changes in the height of the stack of documents without changing the operation of the feed mechanism. As the height of the stack decreases, the relative vertical position of the driving and driven gears changes. This alters the timing of the feed mechanism operation in a manner which insures that the documents will be properly spaced in their movement to the printing mechanism.

Also, as the document moves forward and encounters the inclined ramp, resistance to further movement is encountered; and a reaction torque is generated. This torque is transmitted through the hollow drive shaft to the driven spur gear which accordingly tends to rotate about the driving gear fixed to the printing mechanism drive shaft. This tends to swing the feed member support structure upwardly about the shaft. As a consequence, the feed member is slightly elevated. This is important in that it reduces the pressure on the stack and the frictional force between the documents of which it is composed, reducing the tendency for two documents to be displaced at one time by the rotating feed member.

This action is further enhanced by the location of the feed rollers relative to the inclined ramp. As the document being displaced is pushed up the ramp it bridges in an arc from the ramp to the stack of documents (or document support). The feed roller circumference is generally centered on this arc. Accordingly, spring quality of the bridged portion maintains contact between the document being fed and the friction members when the feed roller moves up under the influence of the reaction torque.

Also important is the provision for limited rotation of the feed member about its drive shaft. The speed of the document being fed will increase as it is drivingly engaged by the printing mechanism. The provision for rotary movement of the feed member relative to its drive shaft permits the feed member to rotate faster than the drive shaft when this occurs, accommodating the change in speed of the document and creating a dwell after the speed up. During this period, slack between the drive shaft and the feed member is taken up; and there is no reaction torque. Consequently the feed member moves downwardly into full pressure engagement with the succeeding item to begin the next cycle.

Aside from the foregoing my invention has the advantage that machines constructed in accord with its principles are simple, compact, and easy to operate. Only minimal maintenance is required, and this is easily accomplished.

One primary object of my invention has been identified above.

Other important but more specific objects of my invention reside in the provision of novel, improved document imprinting devices which:

1. are compact and require only a small operating space;
2. are simple, efficient, and easy to operate;
3. are essentially trouble-free and easily serviced;
4. automatically feed documents one at a time from a stack thereof to a mechanism which prints the wanted information on them and then restacks the documents;
5. have various combinations of the foregoing attributes.

Still other important objects of the invention reside in the provision of novel, improved document feed mechanisms which can be employed in printing devices as disclosed herein and in other applications and which:

6. are capable of efficiently feeding documents that are bent, crumpled, or otherwise distorted from their original shape;
7. minimize the possibility of two documents being fed simultaneously;
8. maintain a selected spacing between successive documents;
9. operate effectively and consistently over a wide range of stack heights;
10. are simple, rugged, and easily serviced;
11. have various combinations of the just-listed attributes.

Still another important object of my invention resides in the provision of novel printing mechanisms of the character and having the attributes described above.

Other important objects and features and additional advantages of my invention will become apparent from the appended claims and the foregoing general description and as the ensuing detailed description and discussion proceeds in conjunction with the accompanying drawing in which:

Figure 1:
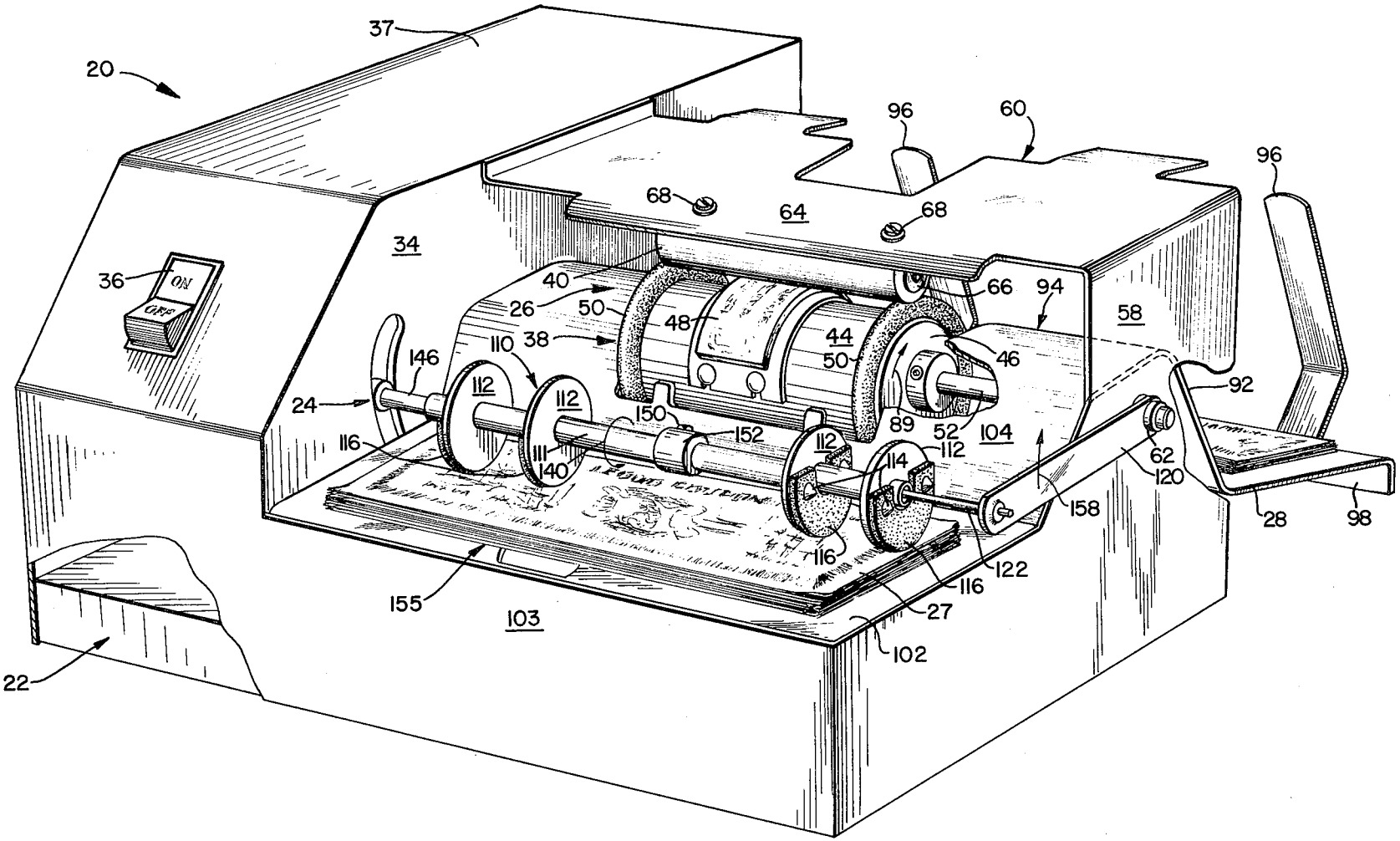
FIG. 1 is a pictorial view of a document imprinter constructed in accord with the principles of the present invention.

Referring now to the drawing, FIG. 1 illustrates a printing device 20 constructed in accord with the principles of the present invention and, more specifically, a food stamp canceller constructed in accord with those principles.

Machine 20 includes a sheet metal base 22 of a construction which is unimportant except as hereinafter indicated. Mounted on the base are a feed mechanism 24, a printing mechanism 26 for printing wanted information on sheets of material 27 (in this case food stamps) fed to it by mechanism 24, and a platform 28 on which the food stamps are automatically stacked as they exit from the printing mechanism. The remaining major components of the device are a motor 30 and gear reduction drive 32 (FIG. 2) for operating feed and printing mechanisms 24 and 26, both supported from a vertical bracket 34 attached to base 22, and an on-off switch 36 for controlling the operation of the device. Switch 36 is supported from a motor and reduction drive cover 37.

Figure 3:
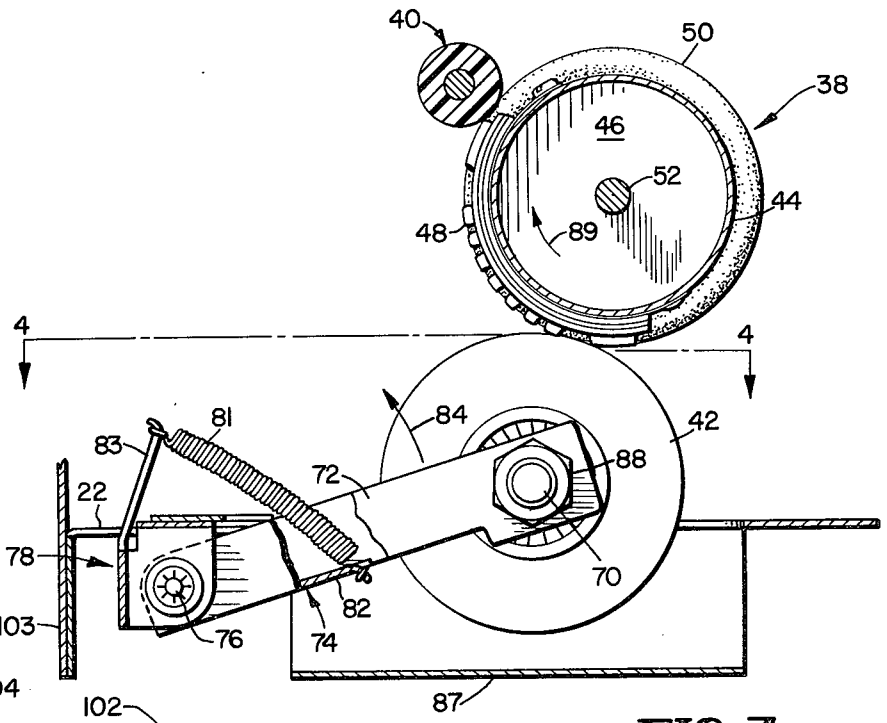
FIG. 3 is an elevation of the printing mechanism employed in the document imprinter.

As shown in FIGS. 1 and 3, printing mechanism 26 includes an print roll 38, a free-wheeling back-up roll 40, and a free-wheeling inking roll 42.

The print roll includes a cylinder 44 to which circular end pieces 46 are attached. Fixed to the cylinder 44 of the print roll is a conventional resilient pad 48 bearing the information which it is desired to transfer to the food stamps as they are fed through printing mechanism 26.

O-ring like, drive members 50 of a resilient, high friction material at opposite ends of the print roll cooperate with back-up roll 40 to effect positive movement of the food stamps 27 through the printing mechanism and to insure positive contact between the latter and impression pad 48.

Figure 2:
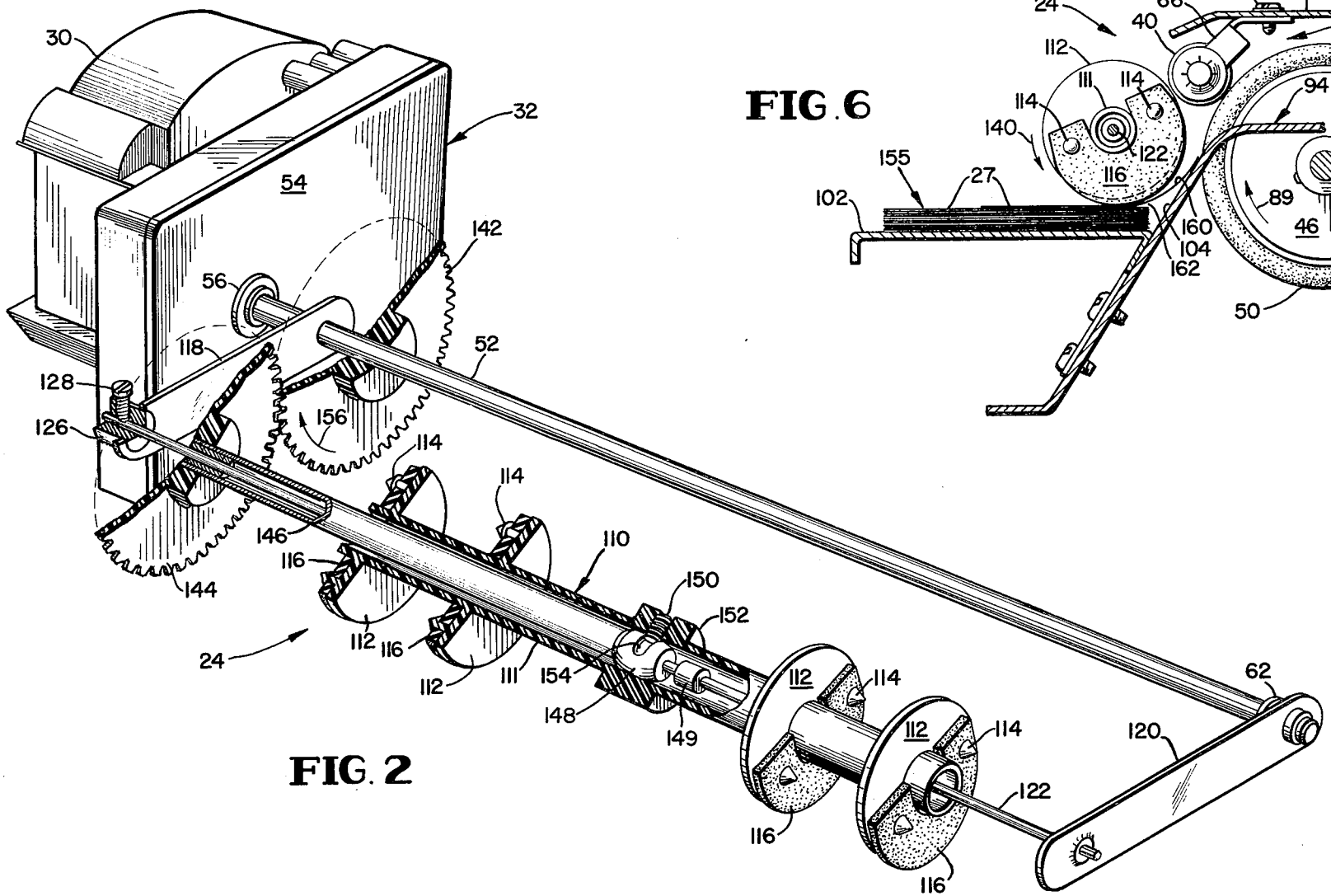
FIG. 2 is a pictorial view of a document feed mechanism employed in the document imprinter of FIG. 1.

The print roll is fixed in any convenient manner for rotation therewith to the output shaft 52 of gear reduction drive 32. As best shown in FIG. 2, this shaft is supported at one end from the housing 54 of the gear reduction drive by bushing 56. At its opposite end, shaft 52 extends through an aperture in the vertical wall 58 of a cover 60 from which it is rotatably supported in a bushing 62.

Figure 6:
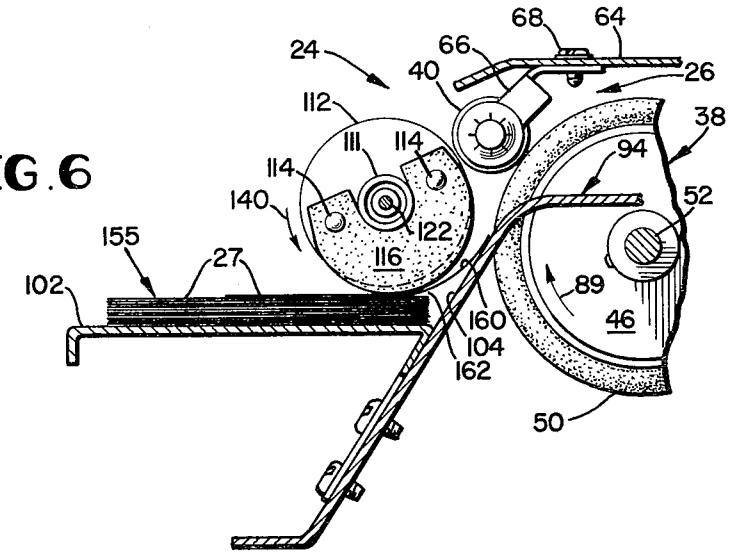
FIG. 6 is a partial elevation showing the relationship between the feed member of the document feed mechanism and the document as the latter is displaced by the feed mechanism up a ramp to the printing mechanism.

As best shown in FIGS. 1 and 6, the back-up roll is attached to the top wall 64 of cover 60 by brackets 66 at opposite ends of the roll (only one of which is shown) and screws 68.

Figure 4:
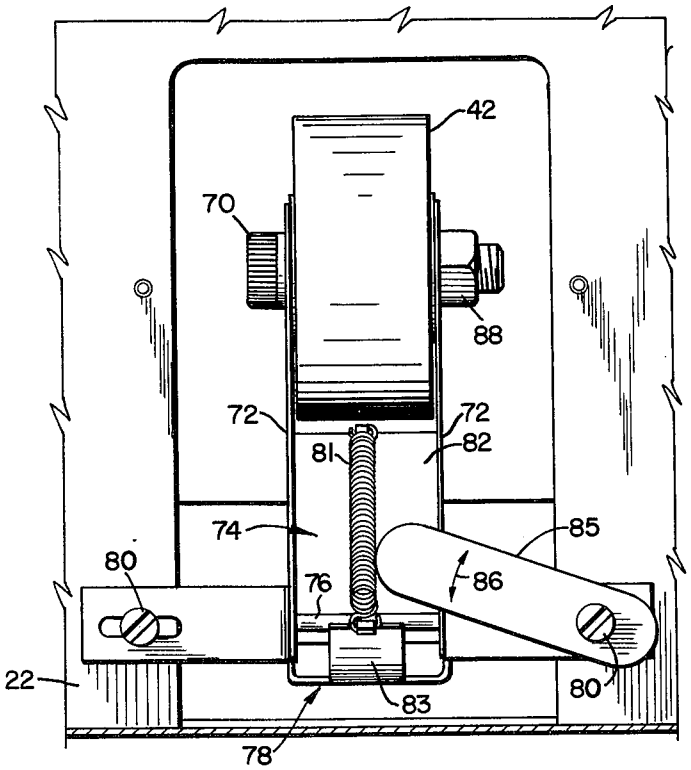
FIG. 4 is a partial plan view taken substantially along line 4—4 of FIG. 3 showing an inking roll incorporated in the printing mechanism and the structure by which it is supported from the base of the document imprinter.

Referring now to FIGS. 3 and 4, inking roll 42 is a commercially available component of resilient, absorbent, ink-filled material. It is rotatably supported by pin 70 from the legs 72 of a generally U-shaped bracket 74. Bracket 74 is supported on a pivot member 76 which, in turn, is mounted in a bracket 78 fixed to the base 22 of the device as by screws 80. A spring 81 extending between the bottom 82 of bracket 74 and an upstanding portion 83 of bracket 78 biases inking roll 42 in the direction shown by arrow 84 in FIG. 3 into contact with impression pad 48 to transfer ink from the inking roll to the impression pad.

A finger 85, also fixed to base 22 by one of two screws 80, limits the upward movement of bracket 74 and, therefore, the force between the latter and the stamp or impression pad. As bracket 74 has an upwardly inclined orientation, this force can be adjusted by repositioning finger 85 about screw 80 as shown by the double-headed arrow 86 in FIG. 4.

A protective cover 87 is screwed to the bottom side of base 22 beneath ink roller 42. By removing this cover, rotating bracket 74 downwardly, and removing a nut 88, pin 70 can be removed and inking roll 42 replaced as necessary.

Movement of switch 36 to the "on" position energizes motor 30 which, through reduction drive 32 and shaft 52, drives print roll 38 in the direction indicated by arrow 89 in FIGS. 1, 3, and 6. As the print roll rotates, it displaces food stamps 27 delivered to the printing mechanism by feed mechanism 24 through the nip between the print and backup rolls 38 and 40. As a food stamp passes therethrough, the wanted information is transferred to it from impression pad 48.

After passing through the nip between the two rolls, the imprinted food stamp 27 slides down an inclined wall 92 of a sheet metal, cover and ramp member 94 onto platform 28. The platform is an integral part of member 94 in the illustrated embodiment of the invention.

Guides 96 keep and promote the stacking of the imprinted food stamps on platform 28. These guides are attached in any convenient manner to a depending flange 98 at the rear of the platform.

Referring back to FIG. 1, the food stamps 27 to be imprinted are placed on a platform 102 supported from base 22 of the printing device between the front wall 103 of cover 60 and an inclined ramp 104 formed as an integral part of member 94.

Figure 5:
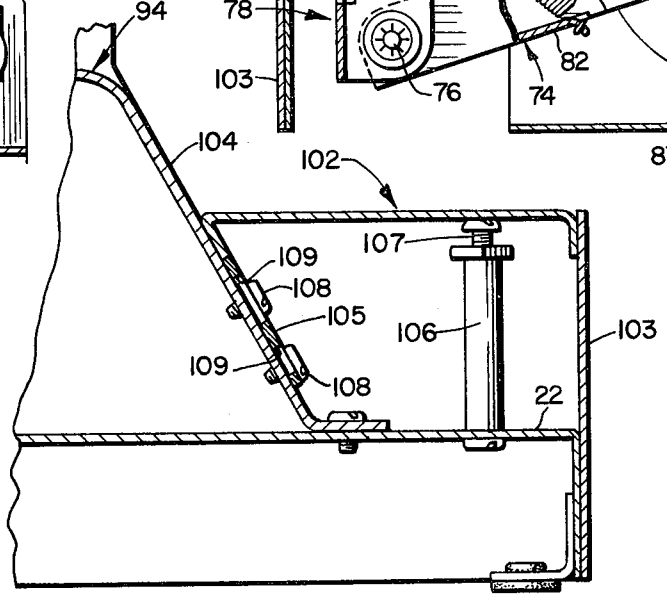
FIG. 5 is a fragmentary vertical section through the document imprinter showing how the feed platform for the documents to be printed is supported.

As shown in FIG. 5, platform 102 is supported by vertically adjustable brackets 105 and by vertical posts 106 into which adjusting screws 107 are threaded (only one bracket and one post are shown). Brackets 105 are fixed to delivery ramp 104 by screws 108 which extend through elongated slots 109 in the brackets and are threaded into the ramp. Support posts 106 are fixed in any convenient manner to base 22 of the device.

The novel mounting arrangement just described allows the angle imparted to the document by the inclined ramp 104 to be adjusted. If the angle is too steep, that is, the left hand side of platform 102 is too high in the sense of FIG. 6, the force needed to move documents up the ramp may be too high for the mechanism to function properly. If the angle is too low, that is, the left hand side of platform 102 is too low in the sense of FIG. 6, the reaction torque necessary for the mechanism to operate properly will not be developed.

Referring now specifically to FIGS. 1 and 2, it will be appreciated from the foregoing that it is the function of feed mechanism 24 to displace the stamps 27 from platform 102 up ramp 104 to the nip between impression and back-up rolls 38 and 40 for engagement by the latter and displacement through the printing mechanism in the manner just described.

Feed mechanism 24 includes an elongated, feed member 110 consisting of a hollow, elongated, tubular hub 111 with radial, circular flanges 112 at intervals therealong. Fixed to each of the flanges 112 by headed projections 114, which facilitate removal and replacement, is a generally semicircular, drive member 116 fabricated of a resilient material having a relatively high coefficient of friction. All of the members 116 are similarly aligned about the axis of rotation of feed member 110 so they will engage the document 27 at the same time and keep it from being moved sideways or at an angle as it proceeds toward and up ramp 104.

Feed member 110 is supported for movement through an arc having the axis of rotation of gear reduction drive output shaft 52 as its axis by brackets 118 and 120 and support shaft 122. Bracket 118 is journalled on shaft 52 for rotation thereabout adjacent gear reduction drive 32. The second bracket, 120, is similarly journalled on the opposite end of the drive shaft adjacent the side wall 58 of cover 60 by bushing 62.

Support shaft 122 extends through the hub 111 of feed member 110 which is internally dimensioned so it can rotate freely about and pivot relative to shaft 122 at a location intermediate the ends of the hub.

One end of shaft 122 is fixed to bracket 120 as by brazing so as to be parallel with the document support. The opposite end of the support shaft extends through a hub 126 on bracket 118 and is fixed to the bracket as by one or more screws 128.

In the operation of device 20, feed member 110 is rotated about support shaft 122 in the direction indicated by arrow 140 in FIGS. 1 and 6 by gear reduction drive output shaft 52, spur gears 142 and 144, and a hollow drive shaft 146.

Shaft 146 extends part way through the hub 111 of the drive member and terminates in a ball 148 adjacent which a stop 149 fixed to support shaft 122 is located. The ball is larger than the outer diameter of shaft 146 and closely fits the internal diameter of the hub, thereby providing a pivotal connection between the drive member and the hub.

Spur gear 142 is fixed to drive shaft 52 for rotation thereby. Drive shaft 146 is similarly fixed to spur gear 144.

As shown in FIG. 1, the hub 111 of feed member 110 is fixed to drive shaft 146 at a point intermediate the ends of the hub for rotation thereby as by a shoulder screw 150. Screw 150 extends through a flange 152 on the hub into a groove 154 typically extending on the order of 20° around the ball 148 at the end of drive shaft 146.

This method of connecting the feed member to its drive shaft, coupled with the use of a hub having a larger internal diameter than the external diameter of the drive and support shafts, permits the feed member to tilt or pivot relative to the drive shaft and support shaft 122. This provides maximum contact between the drive members 116 and the stamps 27 on platform 102.

The elongated groove 154 in the drive shaft allows limited rotation of feed member 110 relative to drive shaft 146. As discussed above, such relative movement is important in that it accommodates the increase in speed the food stamps experience as they enter the nip between back-up and print rolls 40 and 38 and are drivingly engaged by the latter, and permits the drive shaft to rotate relative to the drive member at the end of the feed cycle. There is accordingly no reaction torque tending to drive gear 144 about gear 142 during this portion of the cycle, and feed member 110 moves downwardly to exert its full force on the succeeding document at the beginning of the next feed cycle. This produces a spacing between succeeding documents which may be particularly advantageous if a counting mechanism is incorporated into the illustrated device.

The novel feed mechanism just described automatically compensates for decreases in the height of stack 155 as successive stamps are removed from it. As the height of the stack decreases, the spatial relationship between the friction drive members 116 and print roll 38 changes to compensate for the increased distance the items travel to reach the nip between print roll 38 and back-up roll 40. Feed member 110 is made of a material such as Nylon having a low coefficient of friction. Accordingly, there is an interval in each rotation of the feed member — that in which flanges 112 rather than friction members 116 are in contact with the stamps — in which no driving force is exerted on the stamps. This insures that each stamp follows the preceding one toward the printing mechanism at the wanted interval.

Furthermore, as shown in FIG. 5, the food stamp 27 moving up ramp 104 bridges in an arc between the ramp and platform 102 (or stack 155 of stamps). The axis of rotation of feed member 110 is located so that the peripheries of drive members 116 will be located over the bridged portions of the items being fed. This increases the angle of contact and therefore the driving force between the drive members and the items because the latter tend to wrap around the drive members.

Furthermore, with gear reduction drive output shaft 52 and gear 142 rotating in the direction indicated by arrow 156 in FIG. 2, the reaction torque caused by the document's resistance to the change of direction as they contact ramp 104 tends to drive gear 144 about gear 142 in direct response and in proportion to the resistance incurred. This rotates the assembly of bracket 118 and 120 and support shaft 122 about shaft 52 in the direction indicated by arrow 158, elevating feed member 110 as discussed briefly above.

Because feed member 110 can pivot relative to drive shaft 146 as the feed member moves upwardly, the force which the several friction members 116 exert on stack 155 tends to remain equal (although it may decrease) as they are more apt to follow irregularities in and maintain the same degree of, or equal contact with, the stack.

This action is intensified by the bridging action as the item moves up ramp 104. An air space is created between the document being moved and succeeding items directly beneath the point of contact of friction member 116 as shown at 162 in FIG. 6. This is effective to separate friction member 116 and the item being displaced from succeeding items, reducing the tendency for multiple items to be displaced simultaneously.

An exemplary embodiment of the invention has been described in detail above. However, the invention may be embodied in other specific forms without departing from the spirit or essential characteristics thereof. Also, the printing and feed mechanisms of the present invention can be used independently of each other; and the principles of the invention can be used to advantage in the manufacture of machines for a variety of applications not enumerated above. The forementioned exemplary embodiment is therefore to be considered in all respects as illustrative and not restrictive, the scope of the invention being indicated by the appended claims rather than by the foregoing description; and all changes which come within the meaning and range of equivalency of the claims are intended to be embraced therein.

What is claimed and desired to be secured by Letters Patent is:

1. A document feed mechanism which includes a document support means; a feed mechanism for displacing a document along a rectilinear path from said support means; and means which engages the displaced document and propels it along a continuation of said rectilinear path, said feed mechanism including a shaft extending at right angles to the path of movement of the document; means for rotating said shaft at a preselected speed; a document engageable, rotatable feed member journalled on said shaft; means for drive connecting said feed member to said shaft so that said shaft can rotate said feed member to initiate the displacement of the document, so that the feed member can thereafter rotate relative to the shaft as engagement of a document by the means which propels it along the continuation of the rectilinear path results in a change in the speed at which the document is then moving, and so that the shaft can rotate relative to the feed member at the end of the feed cycle, the means for drive connecting the feed member to the shaft on which it is journalled comprising a single means interconnecting said shaft and said feed member and providing limited rotation of said feed member with respect to said shaft and a pivotal interconnection between said feed member and said shaft whereby said feed member can pivot about said single means within a plane drawn through the axis of said shaft to thus promote uniform contact between said feed member and the document being displaced; a driven gear rotatable with said feed member; a driving gear meshed with said driven gear; means for rotating said driving gear in a direction opposite to the direction of document displacement; and means supporting said feed member and said driven gear for movement in an arcuate path about the axis of rotation of the driving gear whereby document engendered resistance to rotation of the feed member will create a reaction torque tending to move said feed member upwardly in said arcuate path, thereby lessening the pressure on any documents remaining on said support means as the document engaged by the feed member is displaced and reducing the tendency of a second document to be displaced with the document engaged by the feed member.

2. A document feed mechanism as defined in claim 1 together with a ramp located on that side of the document support means toward which the documents are displaced and inclined at angle thereto whereby that portion of a displaced document bridged between said support means and said ramp will promote contact between the feed member and the document engaged thereby and will in part support said feed member; decreasing the friction between said document and a successive document on the support means and thereby further reducing the tendency for such document to be displaced along with the document engaged by the feed member.

3. A document feed mechanism as defined in claim 1 wherein the means for rotating the drive gear includes an elongated drive shaft rotatable with said drive gear and wherein the means supporting the driven gear and the feed member for pivotal movement about the axis of rotation of the drive gear includes brackets at the opposite ends of said elongated shaft, said brackets being journalled at one end thereof on said elongated shaft for rotation thereabout and extending transversely and in the same direction from said drive shaft, and an elongated support oriented parallel to said drive shaft, said support extending between and being fixed to said brackets at the opposite ends thereof and said driven gear, said feed member and said feed mechanism shaft being rotatably journalled on said support.

4. A document feed mechanism which includes a document support means; a feed mechanism for displacing a document along a rectilinear path from said support means; and means which engages the displaced document and propels it along a continuation of said rectilinear path, said feed mechanism including a shaft extending at right angles to the path of movement of the document, means for rotating said shaft at a preselected speed, a document engageable, rotatable feed member journalled on said shaft, and means for drive connecting said feed member to said shaft so that said shaft can rotate said feed member to initiate the displacement of the document, so that the feed member can thereafter rotate relative to the shaft as engagement of a document by the means which propels it along the continuation of the rectilinear path results in a change in the speed at which the document is then moving, and so that the shaft can rotate relative to the feed member at the end of the feed cycle, the means so drive connecting the feed member to the shaft on which it is journalled comprising a single means interconnecting said shaft and said feed member and providing limited rotation of said feed member with respect to said shaft and a pivotal interconnection between said feed member and said shaft whereby said feed member can pivot about said single means within a plane drawn through the axis of said shaft to thus promote uniform contact between said feed member and the document being displaced, said single means interconnecting the feed member and the shaft on which it is journalled being composed of a groove in and extending around the circumference of one of said feed member and said shaft and a member extending from the other of said feed member and said shaft into said groove and being moveable therealong.

5. A document feed mechanism which includes: a document support means and rotatable feed means for engaging and displacing a document from said support means, said feed means comprising an elongated shaft, disc-shaped supports at intervals along said shaft, and replaceable, document engageable drive members each being made of a material having a high coefficient of friction and having a configuration in the shape of a segment of a circle extending about one-half way around said support, each drive member and its support further including means for detachably fixing the drive member on its support whereby each drive member may be easily removed when worn and replaced by a new drive member, and said means for detachably fixing each drive member on its support comprising a pair of headed projections extending laterally from said support and a pair of mounting legs on said drive member, each leg including means defining a mounting hole therein whereby said legs may be easily slipped onto said support over said projections and removed therefrom.

* * * * *